US007469757B2

(12) United States Patent
Azar et al.

(10) Patent No.: US 7,469,757 B2
(45) Date of Patent: Dec. 30, 2008

(54) DRILL BIT WITH DIAMOND IMPREGNATED CUTTER ELEMENT

(75) Inventors: Michael G. Azar, The Woodlands, TX (US); Timothy Beaton, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 524 days.

(21) Appl. No.: 10/745,171

(22) Filed: Dec. 23, 2003

(65) Prior Publication Data

US 2004/0154840 A1 Aug. 12, 2004

Related U.S. Application Data

(60) Provisional application No. 60/436,204, filed on Dec. 23, 2002.

(51) Int. Cl.
*E21B 10/46* (2006.01)

(52) U.S. Cl. ..... 175/432; 175/434; 76/108.2

(58) Field of Classification Search ..... 175/428, 175/434, 426, 432, 431; 299/111
See application file for complete search history.

(56) References Cited

U.S. PATENT DOCUMENTS

| | | | | |
|---|---|---|---|---|
| 3,726,352 | A * | 4/1973 | Roos et al. | 175/413 |
| 4,073,354 | A | 2/1978 | Rowley et al. | 175/329 |
| 4,718,505 | A | 1/1988 | Fuller | 175/329 |
| 4,823,892 | A | 4/1989 | Fuller | 175/329 |
| 4,889,017 | A | 12/1989 | Fuller et al. | 76/108 |
| 4,991,670 | A | 2/1991 | Fuller et al. | 175/329 |
| 5,332,051 | A | 7/1994 | Knowlton | 175/430 |
| 5,607,024 | A * | 3/1997 | Keith et al. | 175/431 |
| 5,924,501 | A * | 7/1999 | Tibbitts | 175/429 |
| 6,068,072 | A | 5/2000 | Besson et al. | 174/428 |
| 6,241,036 | B1 * | 6/2001 | Lovato et al. | 175/432 |
| 6,394,202 | B2 | 5/2002 | Truax et al. | 175/434 |
| 6,458,471 | B2 * | 10/2002 | Lovato et al. | 428/553 |
| 2001/0047891 | A1 * | 12/2001 | Truax et al. | 175/426 |

FOREIGN PATENT DOCUMENTS

| | | |
|---|---|---|
| EP | 0592210 | 4/1994 |
| GB | 2313863 | 12/1997 |
| GB | 2338007 | 12/1999 |

OTHER PUBLICATIONS

Patents Act 1977: Search Report under Section 17 for Application No. GB 0329855.1 dated Mar. 26, 2004 (2 p.).

* cited by examiner

*Primary Examiner*—William P Neuder
(74) *Attorney, Agent, or Firm*—Conley Rose, P.C.

(57) ABSTRACT

The present invention provides a bit with cutting structures or inserts that include diamond particles, in which the diamond-impregnated inserts are surrounded by substantially diamond-free support members. The diamond-impregnated inserts are manufactured separately from the bit body. Once formed, the diamond-impregnated inserts are affixed to the substantially diamond-free support members on bit body by brazing or other means of attachment. The total thermal exposure of the diamond particles during manufacture in accordance with the present invention is significantly lower than the total manufacturing-related thermal exposure in previously known diamond-impregnated cutting structures. Furthermore, the substantially diamond-free support members allow the bit to continue cutting through a formation without an increased contact area, as experienced by bits with diamond-impregnated ribs. Thus, the operating life of the cutting structures, and therefore the life of the bit itself, is increased.

12 Claims, 5 Drawing Sheets

DRILL BIT WITH DIAMOND IMPREGNATED CUTTER ELEMENT

CROSS-REFERENCE TO RELATED APPLICATIONS

The present application claims benefit of U.S. provisional application Ser. No. 60/436,204 filed Dec. 23, 2002 and entitled "Ribless Bit With Diamond Impregnated Cutter Elements," which is incorporated herein by reference.

STATEMENT REGARDING FEDERALLY SPONSORED RESEARCH OR DEVELOPMENT

Not applicable.

TECHNICAL FIELD OF THE INVENTION

The present invention relates generally to drill bits used in the oil and gas industry, where the drill bits have diamond impregnated cutting surfaces. Still more particularly, the present invention relates to drag bits in which the diamond impregnated cutting surfaces are surrounded by substantially diamond-free support members.

BACKGROUND OF THE INVENTION

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earthen formation and proceeds to form a borehole along a predetermined path toward a target zone.

Different types of bits work more efficiently against different formation hardnesses. For example, bits containing inserts that are designed to shear the formation frequently drill formations that range from soft to medium hard. These inserts often have polycrystalline diamond compacts (PDC's) as their cutting faces.

Roller cone bits are efficient and effective for drilling through formation materials that are of medium to hard hardness. The mechanism for drilling with a roller cone bit is primarily a crushing and gouging action, in that the inserts of the rotating cones are impacted against the formation material as the cones rotate. This action loads the formation material beyond its compressive strength and allows the bit to cut through the formation.

For still harder materials, the mechanism for drilling changes from shearing to abrasion. For abrasive drilling, bits having fixed, abrasive elements are preferred. While bits having abrasive polycrystalline diamond cutting elements are known to be effective in some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

During abrasive drilling with a diamond-impregnated cutting structure, the diamond particles scour or abrade away concentric grooves while the rock formation adjacent the grooves is fractured and removed. As the matrix material that supports the diamond granules is worn away, the diamonds at the surface eventually fall out and other diamond particles are exposed.

To form a diamond-impregnated bit, diamonds, which are available in a wide variety of shapes and grades, are placed in predefined locations in a bit mold. Alternatively, composite components, or segments comprising diamond particles in a matrix material such as tungsten carbide/cobalt (WC—Co) can be placed in predefined locations in the mold. Once the diamond-containing components have been positioned in the mold, other components of the bit are positioned in the mold. Specifically, the steel shank of the bit is supported in its proper position in the mold cavity along with any other necessary formers, e.g. those used to form holes to receive fluid nozzles. The remainder of the cavity is filled with a charge of tungsten carbide powder. Finally, a binder, and more specifically an infiltrant, typically a nickel brass alloy, is placed on top of the charge of powder. The mold is then heated sufficiently to melt the infiltrant and held at an elevated temperature for a sufficient period to allow it to flow into and bind the powder matrix or matrix and segments. By this process, a monolithic bit body that incorporates the desired components is formed.

In conventional diamond impregnated bits, as described above, the bits include diamond impregnated ribs that support diamond-impregnated inserts. It has been found that, as the inserts in these bits wear down to the level at which they are embedded in the bit body, the diamond-impregnated structure surrounding each insert begins to contact the formation. Because the support structure is diamond-impregnated, it is wear-resistant and causes a significant increase in the friction when it begins to contact the formation. Hence, the diamond impregnated ribs present a relatively large contact area as wear progresses. Certain rocks such as carbonates are very hard but relatively non-abrasive when compared to silts and sands. The increased contact area makes drilling such formations ineffective and compromises drilling rates, increasing drilling costs significantly. Hence, it is desired to provide apparatus and methods that mitigate the increased contact area caused by conventional ribs and allow efficient drilling in carbonate and other hard formations.

BRIEF SUMMARY OF THE INVENTION

The present invention provides a bit with cutting structures that include diamond particles, in which the diamond impregnated cutting structures are supported by substantially diamond-free support members. "Substantially diamond-free" as used herein means as less than about 10% volume of the total volume of the bit body.

The present invention comprises a bit that includes diamond-impregnated inserts as the cutting structures on at least one blade of the bit. The diamond-impregnated inserts are manufactured separately from the bit body. Once formed, the diamond-impregnated inserts are affixed to the substantially diamond-free support members on the bit body by brazing or other means of attachment.

The substantially diamond-free support members of the present invention allow the bit to continue cutting through a formation without developing an increased contact area as the bit wears, in contrast to the increase in contact area that is experienced by bits with diamond-impregnated ribs. Furthermore, the total thermal exposure of the diamond particles during manufacture in accordance with the present invention is significantly lower than the total manufacturing-related thermal exposure in previously known diamond-impregnated cutting structures. Thus, the operating life of the cutting structures, and therefore the effective life of the bit itself, is increased.

BRIEF DESCRIPTION OF THE DRAWINGS

For a more detailed understanding of the preferred embodiments of the invention, reference will now be made to the accompanying drawings, wherein.

Figure 1A:
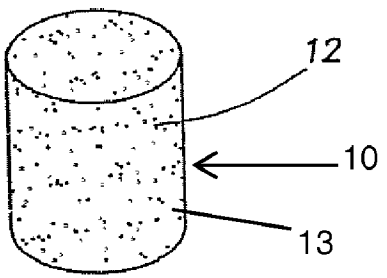
FIG. 1 shows a variety of possible configurations for a diamond-impregnated insert in accordance with the present invention.
Figure 1B:
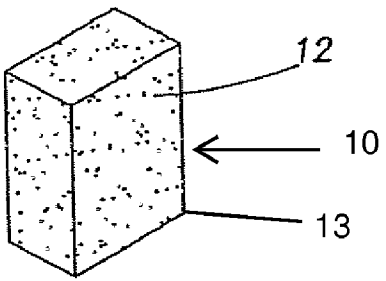
Figure 1C:
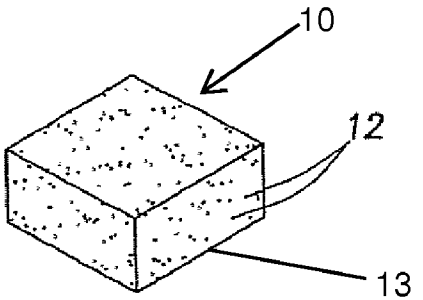
Figure 1D:
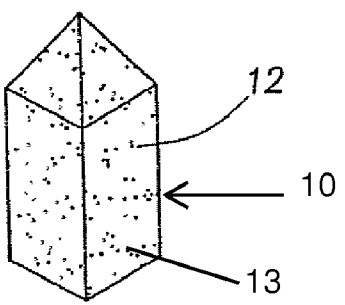
Figure 1E:
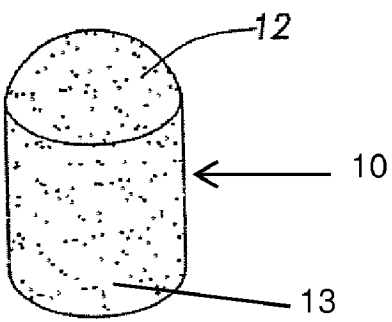
Figure 1F:
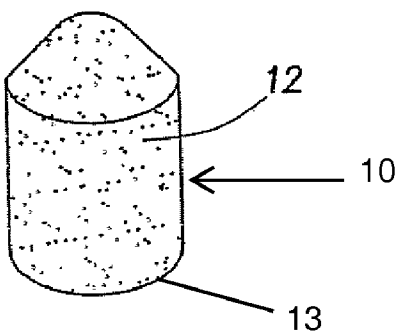

Certain terms are used throughout the following description and claims to refer to particular system components. This document does not intend to distinguish between components that differ in name but not function. In the following discussion and in the claims, the terms "including" and "comprising" are used in an open-ended fashion, and thus should be interpreted to mean "including, but not limited to . . . ."

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

There are shown in the drawings, and herein will be described in detail, various embodiments of the invention with the understanding that the disclosure is to be considered merely an exemplification of the principles of the invention, and is not intended to limit this disclosure including the claims to those embodiments illustrated and described herein.

DETAILED DESCRIPTION OF THE INVENTION

According to a preferred embodiment, diamond-impregnated inserts that will comprise the primary cutting structure of a bit are formed separately from the bit. Because the inserts are smaller than a bit body, they can be hot pressed or sintered for a much shorter time than is required to infiltrate a bit body. Any suitable diamond impregnated inserts can be used in the present invention.

In one preferred embodiment, a plurality diamond-impregnated inserts 10 are manufactured as individual components. Examples of insert shapes are shown in FIG. 1. It will further be understood that the concepts of the present invention can be used in conjunction with any other insert shape, including those described in U.S. provisional application Ser. No. 60/446,967 filed on Feb. 12, 2003, which is incorporated herein by reference in its entirety. Preferred methods for manufacturing inserts 10 are disclosed in commonly owned U.S. Pat. No. 6,394,202 B2, and Application Ser. No. 60/446,967, published at US 20040159471, each of which is incorporated herein by reference in its entirety. According to one preferred embodiment, diamond particles 12 and powdered matrix material are placed in a mold. The contents are then hot-pressed or sintered at an appropriate temperature to form a composite insert 10. Heating of the material can be by furnace or by electric induction heating, such that the heating and cooling rates are rapid and controlled in order to prevent damage to the diamonds.

If desired, a very long cylinder having the outside diameter of the ultimate insert shape can be formed by this process and then cut into lengths to produce diamond-impregnated inserts 10 having the desired length. The dimensions and shape of the diamond-impregnated inserts 10 and of their positioning on the bit can be varied, depending on the nature of the formation to be drilled. However, it is preferred that at least a portion of the base 13 of each insert 10 be substantially diamond-free so that insert 10 has desired wetting capabilities.

The diamond particles can be either natural or synthetic diamond, or a combination of both. The matrix in which the diamonds are embedded to form the diamond impregnated inserts 10 must satisfy several requirements. The matrix must have sufficient hardness so that the diamonds exposed at the cutting face are not pushed into the matrix material under the very high pressures used in drilling. In addition, the matrix must have sufficient abrasion resistance so that the diamond particles are not prematurely released. Lastly, the heating and cooling time during sintering or hot-pressing, as well as the maximum temperature of the thermal cycle, must be sufficiently low that the diamonds imbedded therein are not thermally damaged during sintering or hot-pressing.

To satisfy these requirements, the following materials may be used for the matrix in which the diamonds are embedded: tungsten carbide (WC), tungsten alloys such as tungsten/cobalt alloys (WC—Co), and tungsten carbide or tungsten/cobalt alloys in combination with elemental tungsten (all with an appropriate binder phase to facilitate bonding of particles and diamonds) and the like. In a preferred embodiment, diamonds comprise at least about 5% but less than about 35% volume of the total volume of the cutting structure.

Figure 2:
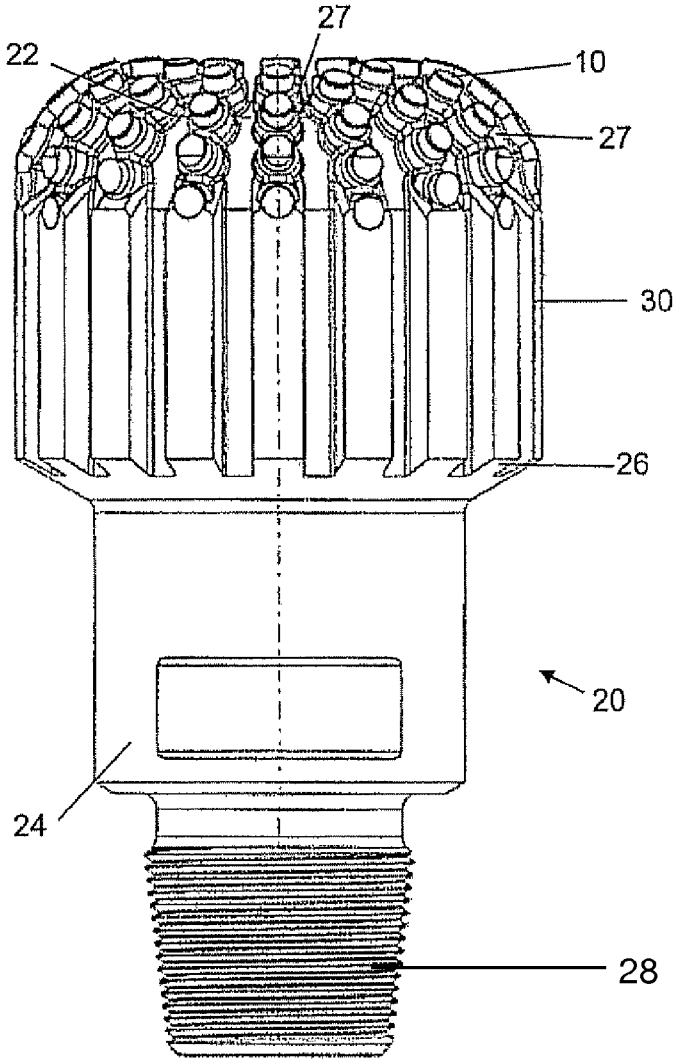
FIG. 2 is a side view of an earth-boring bit made in accordance with the principles of the present invention.
Figure 3:
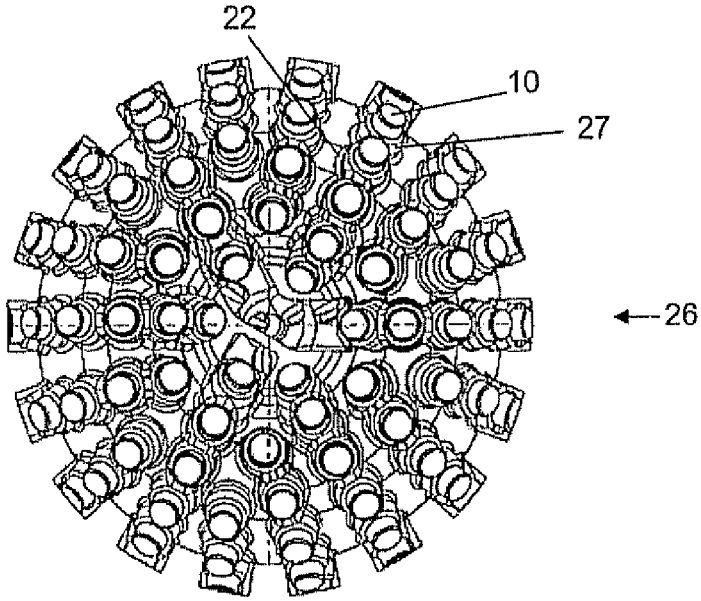
FIG. 3 is a top view of the crown of the bit of FIG. 2.

Referring now to FIGS. 2 and 3, a drill bit 20 according to the present invention comprises a shank 24 and a crown 26. Shank 24 is typically formed of steel and includes a threaded pin 28 for attachment to a drill string. Crown 26 has a cutting face 22 and outer side surface 30. According to one preferred embodiment, crown 26 is formed by infiltrating a mass of tungsten-carbide powder, as is known in the art. Crown 26 preferably includes various surface features, such as support members 27. In a preferred embodiment, support members 27 are substantially diamond-free.

A plurality of cutting elements 10 are mounted in support members 27. It is preferred that each cutting element 10 extend outward from support members 27 by a height that is no more than about 33% of the diameter of the element. As is recognized in the art, bending attributable to the loading of a cutting element by a formation may cause inserts to fracture. It is believed that such degradation of the cutting element is due at least in part to lack of sufficient support of the cutting element so that, when encountering the formation, the insert actually flexes due to lack of sufficient support. As diamond has an extremely low strain to failure, even a small amount of flexure can initiate fracture. The present invention avoids this problem by ensuring that, support members 27 provide sufficient support for diamond-impregnated inserts 10.

Figure 4A:
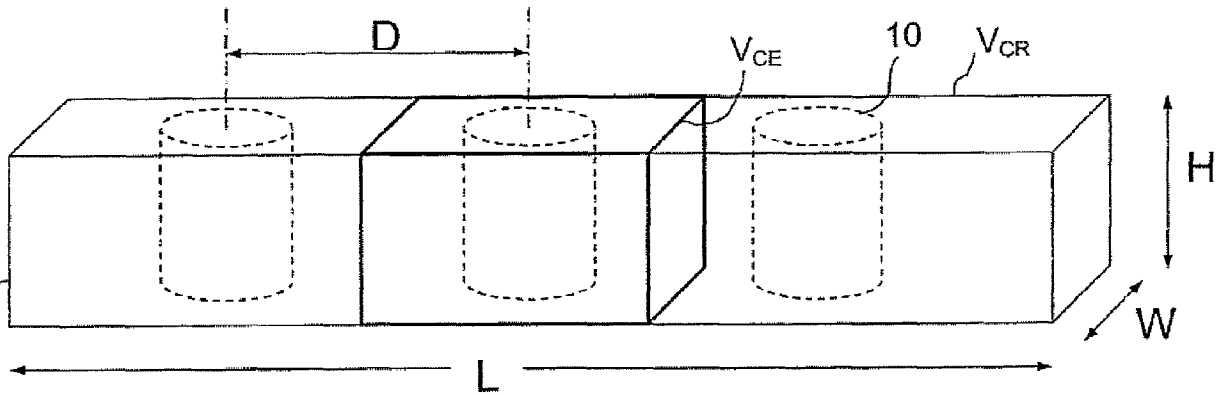
FIG 4A Prior Art
FIGS. 4A-C are schematic illustrations showing the volume of a conventional rib and the volume of a support member in accordance with the present invention.

Another advantage of the present invention is that support members 27 may comprise less volume than conventional ribs, therefore mitigating the increased contact area between the bit and formation. Referring now to FIG. 4A, for purposes of illustration, the volume $V_{CR}$ that a conventional rib 40 occupies is represented as a rectangular prism. For purposes of comparison the conventional rib 40 is depicted schematically as having a width W, a height H, and a length L. In an actual bit, the outer surface of each rib may not be planar. Regardless, for purposes of the present discussion, the conventional rib 40 defines a volume $V_{CR}$ that is equal to a width W multiplied by a set height H multiplied by a set length L (L×H×W). A plurality of cutting elements, or inserts, 10 are mounted in rib 40. Inserts 10 are spaced apart and the distance between their centers is designated D. Still using the schematic representation, the volume of support material $V_{CE}$ attributed to each insert is thus D×H×W. While the actual volume of the rib material does not include the volume occupied by the inserts, the insert volume will be disregarded in the present discussion.

Figure 4B:
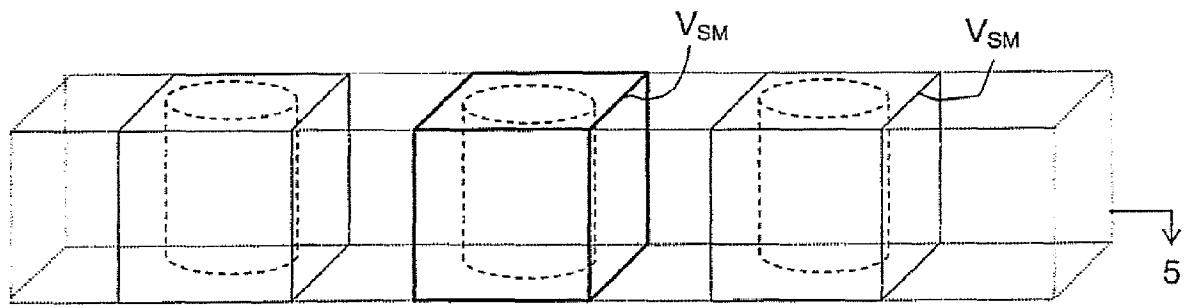
Figure 4C:
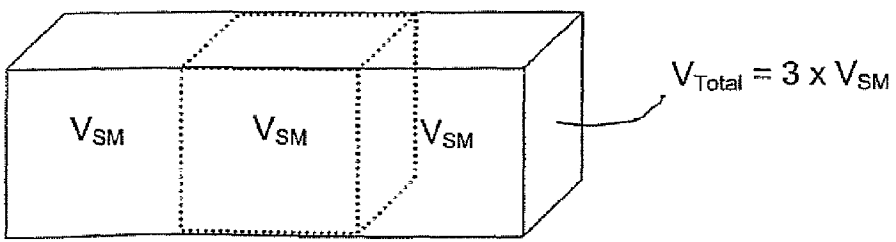

In contrast and referring now to FIG. 4B, the volume $V_{SM}$ occupied by each support member 27 in the present invention may be much smaller. Each insert is supported with a volume of support material $V_{SM}$ that is less than the volume of support material $V_{CE}$ that is attributable to each cutting element in a conventional rib. Correspondingly, support members 27 cumulatively define a volume $V_{Total}$ that is less than a conventional rib $V_{CR}$. In one embodiment, support members define a volume $V_{Total}$ that is less than 75% the volume of $V_{CR}$. In another embodiment, support members define a volume $V_{SM}$ that is less than 50% the volume of a conventional rib $V_{CR}$.

Figures 5A, 5B, 5C, 5D, 5E:
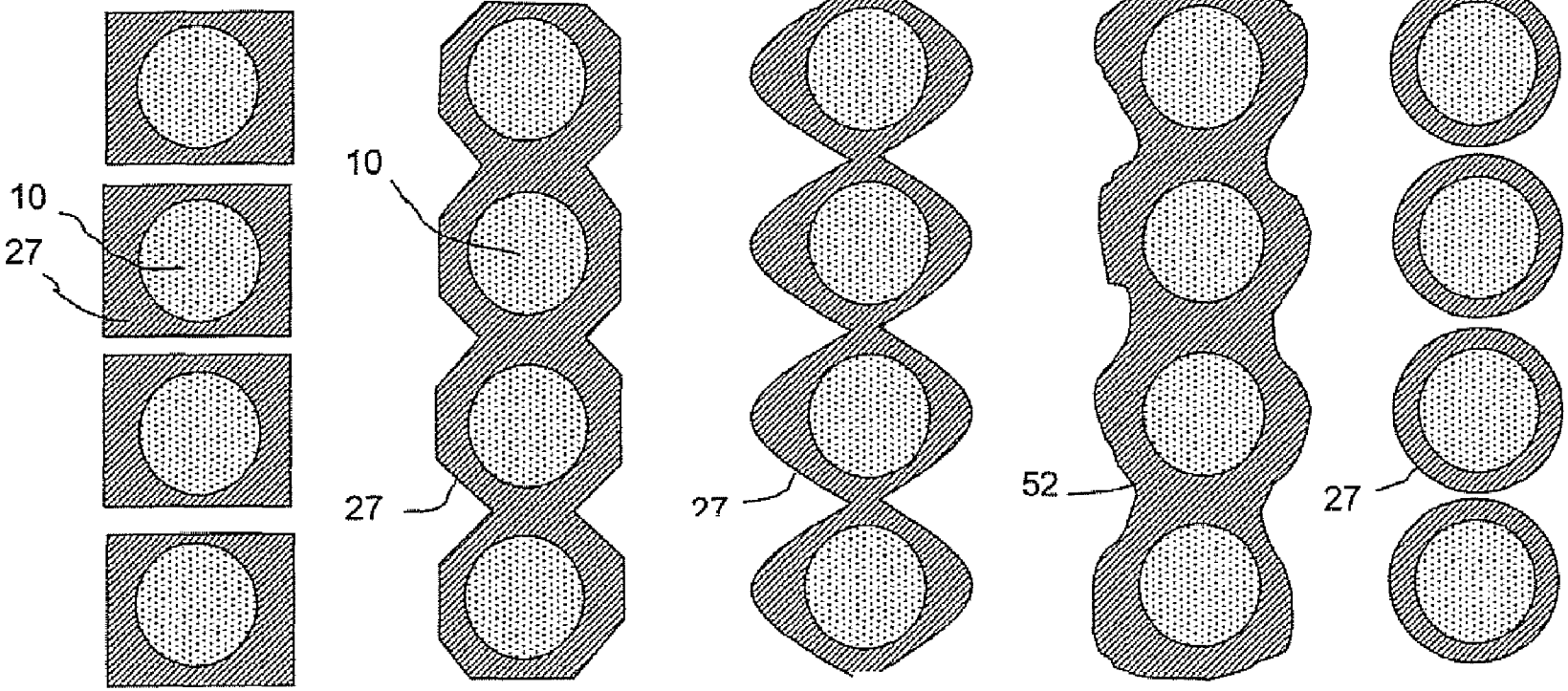
FIG. 5 shows several alternative configurations for a support member in accordance with the present invention, as viewed in the cross section indicated by arrows 5-5 in FIG. 4B.

Referring now to FIG. 5 and viewing support members 27 in the intermediate plane indicated by view lines 5-5 on FIG. 4B, support members 27 may take a variety of shapes. For example, support members 27 may be distinct (FIGS. 5(*a*) and 5(*e*)) or connected to each other (FIGS. 5(*b*)-(*d*)). Also, the outer surface of each support member 27 can comprise a plurality of planar regions (FIGS. 5(*a*) and 5(*b*)) or may be contoured (FIG. 5(*c*)-(*e*)). If the support members have curvilinear surfaces and are not distinct, they will form a substantially curvilinear rib 52 as shown in FIG. 5(*d*).

In another embodiment, support members 27 define a volume $V_{Total}$ that is less than three times, and preferably less than two times, the aggregate volume of the inserts supported by those support members. In another embodiment, support members 27 define a volume $V_{Total}$ that is less than the aggregate volume of the inserts housed in those support members.

In some embodiments, support members 27 may be fabricated from the same material as crown 26 and may or may not be integral with crown 26. In other embodiments, support members 27 may be fabricated from a different material, such as alumina, titanium carbide, silicon carbide, or the like. In addition, and regardless of the configuration of support members 27, the support members for one or more pairs of adjacent inserts may be conjoined along at least a portion of their height, as illustrated in FIGS. 5(*b*), (*c*), and (*d*), or not, as illustrated in FIGS. 5(*a*) and (*e*). In either case, support members 27 are preferably formed from a substantially diamond-free material and are incorporated into a diamond-impregnated or diamond-free bit body during the bit molding process or after molding.

In a preferred embodiment, support members 27 are tapered, such that the base of support member 27 is larger than the top of support member 27. It is also preferred that the support members be configured such that the surface area of the support member that is in contact with the formation remains substantially constant as the insert is worn away.

Referring back to FIGS. 2 and 3, formers are preferably included during the manufacturing process, so that support members 27 include a plurality of holes or sockets (not shown) that are sized and shaped to receive a corresponding plurality of diamond-impregnated inserts 10. Once crown 26 is formed, inserts 10 are mounted in the sockets in support members 27 and affixed by any suitable method, such as brazing, adhesive, mechanical means such as interference fit, or the like. In a preferred embodiment, a silver-based brazing material is used to secure inserts 10 to the bit.

As shown in FIG. 2, the sockets can each be substantially perpendicular to the outer surface of the crown. Alternatively, the sockets can be inclined with respect to the outer surface of the crown. In this embodiment, the sockets are inclined such that inserts 10 are oriented substantially in the direction of rotation of the bit, so as to enhance cutting. While it is preferred that the diamond impregnated inserts form the primary cutting structures of the bit, additional, secondary cutting structures that may or may not be diamond-impregnated may also be included in the bit and more particularly in the substantially diamond-free support structures of the present bits.

Regardless of the volume, shape, or orientation of the insert support members, it is preferred that they be substantially diamond fee. By providing a support material that is less wear-resistant than the diamond-impregnated insert that it supports, it is expected that the support material will wear away at a faster rate than the insert, with the result that a portion of the insert extending beyond the surface of the support is always maintained, even as the insert itself wears away.

Figures 6A, 6B, 6C, 6D, 6E:
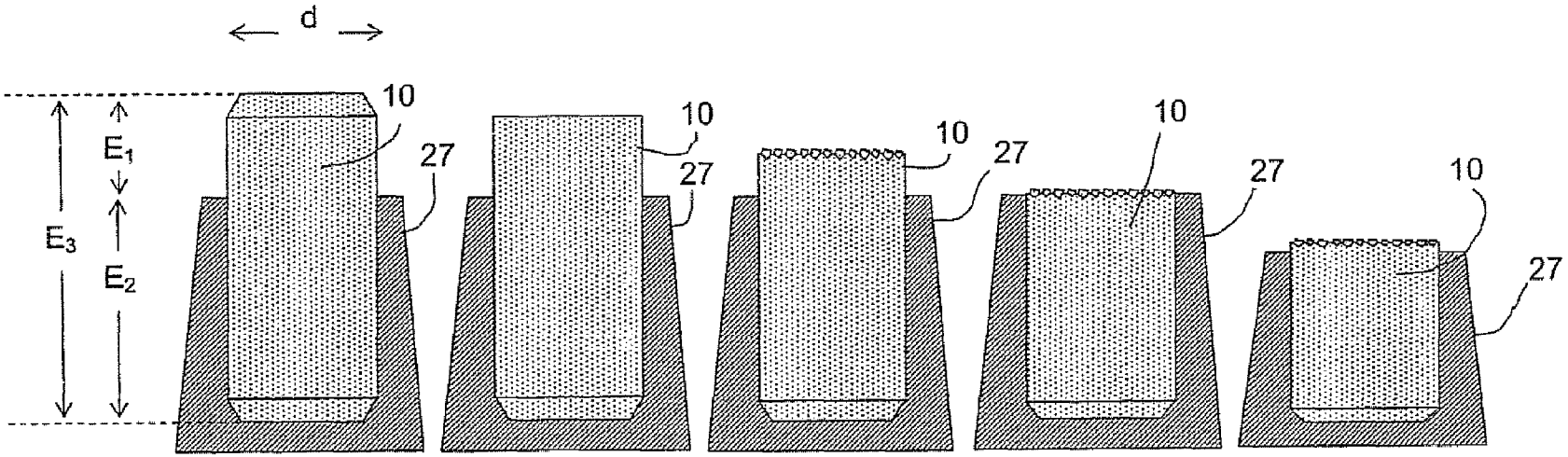
FIGS. 6*a-e* are vertical cross-sectional views of the wear profile of an earth-boring bit made in accordance with the principles of the present invention as the bit wears.

Referring now to FIGS. 6*a-e,* this concept is illustrated with respect to a single insert. The wear profile of a supported insert constructed in accordance with a preferred embodiment is shown. In FIG. 6*a,* the bit is new. The portion of insert 10 that extends above support member 27 is expressed as $E_1$. The portion of insert 10 that is embedded in and surrounded by support member 27 is expressed as $E_2$. The total length of insert 10 is expressed as $E_3$, and is equivalent to the sum of $E_1$ and $E_2$. For practical purposes, the ratio of $E_1$ to the diameter d of insert 10 is less than approximately 3:1 to ensure that insert 10 does not break prematurely. In FIG. 6*a,* the ratio of $E_1$ to $E_2$ is at a maximum. In a preferred embodiment, the ratio of $E_2$ to $E_3$ is less than approximately 2:3 when the bit is new.

In FIGS. 6*b-e* the bit has experienced increasing levels of wear. In FIGS. 6*b-d,* a portion of $E_1$ has been worn away, however $E_2$ is not yet substantially affected. In FIG. 6*e,* portions of both $E_1$ and $E_2$ have been worn away. Because support member 27 is fabricated from a material that is less-wear resistant than inserts 10, and preferably from a substantially diamond-free material, while insert 10 is diamond impregnated, support member 27 wears away faster than insert 10 (i.e. support member 27 has a higher wear ratio than insert 10), such that diamond impregnated material from insert 10 is continuously exposed at the surface of the bit throughout the lifetime of insert 10 and a portion of insert 10 is always exposed beyond the surface of the support member 27 (i.e. $E_1$ is always greater than 0). The term "wear ratio" is herein defined as the ratio of the volume of rock removed to the volume of bit material worn during a given cutting period.

A bit having diamond-impregnated inserts supported in the manner disclosed herein will be able to drill sections of softer formations that would not be readily drillable with conventional diamond-impregnated bits. This is made possible by the shearing action of the insert portions that extend beyond the surface of the bit body (i.e. $E_1$). In one embodiment, the ratio of the wear ratio of support members 27 to the wear ratio of inserts 10 is less than 1:1. In another embodiment, the ratio of the wear ratio of support members 27 to the wear ratio of inserts 10 is less than 1:5. In yet another embodiment, the ratio of the wear ratio of support members 27 to the wear ratio of inserts 10 is less than 1:10.

In some embodiments, inserts 10 may be created to have different lengths, or may be mounted in the bit body at different heights or angles, so as to produce a bit having a multiple height cutting structure. This may provide further advantages in drilling efficiency.

It will be understood that the materials commonly used for construction of bit bodies can be used in the present invention. Hence, in the preferred embodiment, the bit body comprises infiltrated tungsten carbide matrix that does not include diamond. In an alternative embodiment, the bit body itself is diamond-impregnated, but the ribs or other support configurations that extend outwardly from the bit body are not diamond-impregnated.

In another alternative embodiment, the bit body can be made of steel, according to techniques that are known in the art. Again, the final bit body includes a plurality of holes having a desired orientation, which are sized to receive and support diamond-impregnated inserts 10. Inserts 10 are affixed to the steel body by brazing, mechanical means, adhesive or the like. The bit according to this embodiment can optionally be provided with a layer of hard facing.

The present invention allows bits to be easily constructed having inserts in which the size, shape, and/or concentration of diamond in the cutting structure is controlled in a desired manner. As a result of the present manufacturing technique, each diamond-impregnated insert is subjected to a total thermal exposure that is significantly reduced as compared to previously known techniques for manufacturing infiltrated diamond-impregnated bits. Additionally, the support members brace the inserts and additionally serve to ensure that a sharp cutting structure engages the formation without an increased surface area, as drilling progresses.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. For example, additional primary and/or secondary cutting structures that are or are not diamond-impregnated can be included on the bit, as may be desired. Accordingly, the scope of protection is not limited by the description set out above, but is only limited by the claims which follow, that scope including all equivalents of the subject matter of the claims. In any method claim, the recitation of steps in a particular order is not intended to limit the scope of the claim to the performance of the steps in that order unless so stated.

What is claimed is:

1. An earth-boring bit comprising:

a bit body;

a plurality of substantially diamond-free insert support members extending outwardly from said body; and at least one diamond-impregnated insert supported in one of said support members, said at least one diamond-impregnated insert extending outwardly from said support member and forming a primary cutting structure;

wherein said one of said support members defines an aggregate volume $V_{Total}$ that is less than two times the aggregate volume of the at least one diamond-impregnated insert supported in said one of said support members.

2. The bit according to claim 1 wherein said support members are fabricated from the same material as said bit body.

3. The bit according to claim 1 wherein said support members are fabricated from a different material from said bit body.

4. The bit according to claim 1 wherein at least one said diamond-impregnated insert includes thermally stable polycrystalline diamond material.

5. The bit according to claim 4 wherein said diamond-impregnated insert comprises diamond material in a matrix and the diamond material comprises less than about 35% volume of the total volume of at least one said diamond-impregnated insert.

6. The bit according to claim 1 wherein said support members are included in said bit body when said bit body is molded.

7. The bit according to claim 1 wherein at least two adjacent support members are conjoined along at least a portion of their heights.

8. The bit according to claim 1 wherein each diamond-impregnated insert is affixed to the support members by brazing.

9. The bit according to claim 1 wherein the ratio of the wear ratio of the support members to the wear ratio of the inserts comprises at least one of 1:1, 1:5 and 1:10.

10. The bit according to claim 1 wherein at least one of said support members comprises a contoured curvilinear outer surface.

11. The bit according to claim 1 wherein a first plurality of said support members are connected to each other with curvilinear outer surfaces to form a curvilinear rib.

12. An earth-boring bit, comprising:

a bit body having an axis;

a plurality of insert support members extending outwardly from said body;

a first and second insert;

a first support member supporting said first insert and no other insert, said first insert extending outwardly from said first support member and forming a first primary cutting structure; and a second support member supporting said second insert and no other insert, said second insert extending outwardly from said second support member and forming a second primary cutting structure;

wherein said first and second support members are separated by an interstice and arranged to form a row extending outwardly from said bit axis; and wherein said support members define an aggregate volume $V_{Total}$ that is less than two times the aggregate volume of the inserts supported in said support members.

* * * * *